United States Patent [19]

Brenner

[11] 4,239,214

[45] Dec. 16, 1980

[54] BASKETBALL SHOT MAKING GAME WITH A MULTIPLICITY OF BACKBOARD AND HOOP ARRANGEMENTS

[76] Inventor: Reeve R. Brenner, 1356 E. 8th St., Brooklyn, N.Y. 11230

[21] Appl. No.: 960,964

[22] Filed: Nov. 15, 1978

[51] Int. Cl.[3] ..... A63B 63/08; A63B 71/02

[52] U.S. Cl. ..... 273/1.5 R; 273/342; 273/402; 273/411

[58] Field of Search ..... 273/1.5 R, 1.5 A, 105 R, 273/176 A, 342, 402, 411

[56] References Cited

U.S. PATENT DOCUMENTS

| | | | |
|---|---|---|---|
| 1,510,402 | 9/1924 | Hopwood | 273/105 R X |
| 2,194,786 | 3/1940 | Chervenka et al. | 273/1.5 R |
| 2,786,678 | 3/1957 | Fink | 273/1.5 R |
| 3,035,838 | 5/1962 | Johnston | 273/105 R |
| 3,050,304 | 8/1962 | Holsebus | 273/1.5 A |
| 3,388,909 | 6/1968 | Woods | 273/1.5 R |
| 3,477,714 | 11/1969 | Garlington | 273/1.5 R |
| 3,599,981 | 8/1971 | Zausmer | 273/176 A |
| 3,709,489 | 1/1973 | Holleran et al. | 273/105 R X |
| 3,761,089 | 9/1973 | Slane | 273/1.5 R X |
| 3,901,506 | 8/1975 | Caveney | 273/1.5 A |
| 3,910,575 | 10/1975 | Miller | 273/1.5 A |
| 3,951,409 | 4/1976 | Drohomirecky | 273/1.5 R X |
| 4,036,494 | 7/1977 | Hayes | 273/1.5 R |

*Primary Examiner*—Paul E. Shapiro

*Attorney, Agent, or Firm*—Hubbell, Cohen, Stiefel & Gross

[57] ABSTRACT

A basketball shot making game includes a multiplicity of shot making stations each of which has a basket hoop and a backboard associated therewith and wherein each of the backboards is arranged in a different configuration for presenting a different bank shot to be made at each station. Each of the shot making stations includes a predetermined position from which the shot at that particular station should be made.

14 Claims, 14 Drawing Figures

BASKETBALL SHOT MAKING GAME WITH A MULTIPLICITY OF BACKBOARD AND HOOP ARRANGEMENTS

BACKGROUND OF THE INVENTION

1. Field of the Invention

This application relates generally to basketball backboard and hoop arrangements and, in particular, to a basketball shot making game having a multiplicity of shot making stations.

2. Background

The game of basketball normally includes a basket hoop and net arrangement mounted on a backboard through which a leather ball is thrown for the purpose of scoring points. The ball may be thrown directly through the basket hoop or, in the alternative, may be banked off of the backboard in such a way as to cause it to go through the basket hoop. The backboard is usually flat and vertically disposed and large enough to allow bank shots from a variety of different directions. Unfortunately, this orientation of vertical backboard and horizontal hoop only permits a limited number of different bank shots to be made. When the shot making is mixed with a game involving teams including opponents attempting to block shots the variation of bank shots available is large enough to provide sufficient challenge. However, when a game involving just shot making is played, the limitations on the variety of available shots becomes severely obvious.

One attempt to vary the standard backboard arrangement is disclosed in U.S. Pat. No. 4,036,494. That patent shows a backboard having a flat central panel and two flat wing panels hingedly affixed to the sides thereof. Unfortunately, the variation in bank shot which may be made within this backboard is limited because the backboard only has certain portions which may be changed or repositioned.

SUMMARY OF THE INVENTION

Accordingly, a basketball shot making game has been developed which includes a multiplicity of shot making stations each of which has a basket hoop and a backboard associated therewith and wherein each of the backboards is arranged differently with respect to the basket hoop for presenting a different variety of bank shot to be made at each station. In one variation each of the stations includes a predetermined position from which the shot at that particular station should be made.

BRIEF DESCRIPTION OF THE DRAWINGS

The present invention is described below in reference to the appended drawings in which:

FIGS. 1A and 1B show a top view of a basketball shot making game according to the present invention and having twelve shot making stations; FIG. 1C shows the combination FIGS. 1A and 1B;

FIGS. 2 and 2A are perspective views of alternate basket hoop embodiments for one of the shot making stations of FIG. 1A;

FIG. 3 is a perspective view of a backboard and basket hoop arrangement according to another of the shot making stations of FIG. 1A;

FIG. 4 is a perspective view of a backboard and basket hoop arrangement according to another of the shot making stations of FIG. 1A;

FIG. 5 is a perspective view of a backboard and basket hoop arrangement according to another of the shot making stations of FIG. 1A;

FIG. 6 is a perspective view of a backboard and basket hoop arrangement according to another of the shot making stations of FIG. 1A;

FIG. 7 is a perspective view of a backboard and basket hoop arrangement according to one of the shot making stations of FIG. 1B;

FIG. 8 is a perspective view of a backboard and hoop arrangement according to another of the shot making stations of FIG. 1B;

FIG. 9 is a perspective view of a backboard and hoop arrangement according to another of the shot making stations of FIG. 1B;

FIG. 11 is a perspective view of a backboard and hoop arrangement according to another of the shot making stations of FIG. 1B.

DETAILED DESCRIPTION OF THE DRAWINGS

Figures 1A, 1B, 1C, 2, 3, 4, 5, 6:
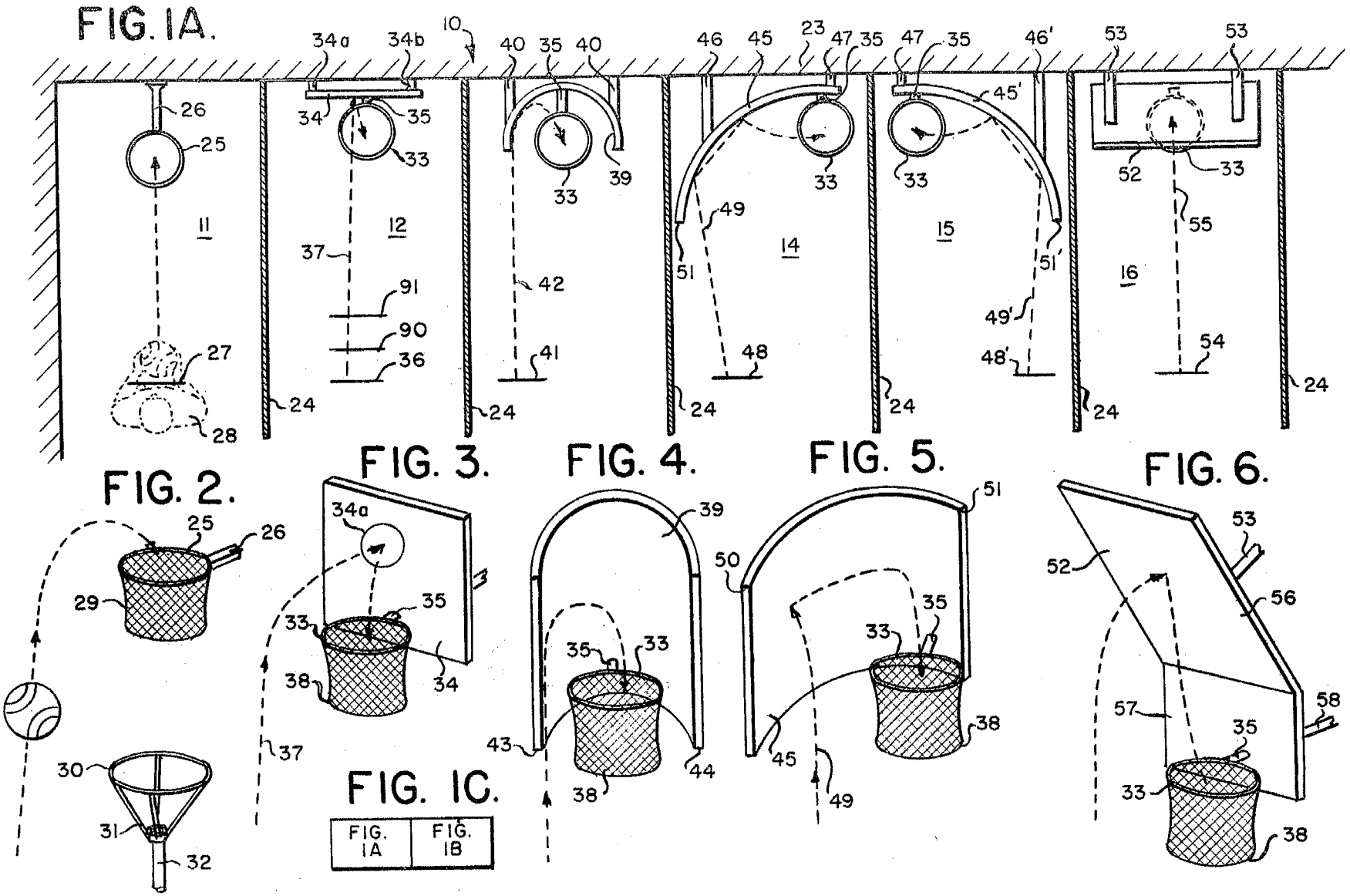

FIGS. 1A and 1B depict a basketball shot making game 10 according to one embodiment of the present invention. The shot making game 10 includes a multiplicity of shot making stations 11–22, each of which includes a different backboard and basket hoop arrangement for presenting a different basketball shot to be made at each station. Each of the backboards and/or hoops are mounted to a suitable supporting structure 23 and adjacent shot making stations are separated by one of a plurality of partitions 24.

One of the shot making stations 11 is called the Swish Shot and includes a basket 25 mounted by a support 26 to a suitable supporting structure 23 (i.e., a wall). The line 27 indicates the position from which the shot at this particular station should be made as shown by the phantom participant 28. The line 27 is typically located 15 feet (4.625 meters) along the ground from the basket hood 25 and the rim of the basket hoop 25 is typically mounted 10 feet (3.05 meters) above the ground. FIGS. 2 and 2A are perspective views of basket hoops suitable for use at the shot making position 11. FIG. 2 shows the basket hoop 25 and the support 26. A net 29 is suspended from the basket hoop 25 and hangs approximately 15–18 inches (38.1–45.7 cm) therefrom. FIG. 2A shows a basket 30 mounted on a threepronged support 31 which in turn is mounted on a pole 32. The pole 32 may be implanted in the ground or in turn mounted to a suitable supporting structure 23. A typical basket hoop which may be used for the embodiments of either FIG. 2 or FIG. 2A is 18 inches (45.7 cm) in diameter.

The shot making station 12 is called the Conventional Shot and includes a conventional basket hoop and backboard arrangement including a basket 33 and a flat, vertically disposed backboard 34. A bracket 35 mounts the basket hoop 33 to the backboard 34. Lines **36*a*, 36*b* and 36*c* indicate the possible positions from which the shot at station 12 may be made. The dotted line 37 indicates a typical bank shot which may be made from this position. FIG. 3 is a perspective view of the basket hoop 33 and backboard 34 of shot making station 12. A net 38 is suspended from the basket hoop 33 and is typically 15–18 inches (38.1–45.7 cm) in length the basket hoop 33 is typically 18 inches (45.7 cm) in diameter. The backboard 34 is square and measures two and a half feet (76.2 cm) along each side. The basket hoop 33 is mounted at the horizontal center of the backboard 34 and approximately 6 inches (15.24 cm) from the bottom thereof. The backboard 34 along with any of the backboards according to the present invention may optionally include markings such as the circle 34***a* indicating either those areas which should be hit to execute the proper bank shot or else those areas which must be hit in executing a shot.

Unless otherwise specified, each of the basket hoops 33 is typically 18 inches (45.7 cm) in diameter and mounted 10 feet (3.05 meters) above the ground. The net 38 attached thereto typically hangs 15–18 inches (38.1–45.7 cm) therefrom.

The shot making station 13 is called the Any Back Shot and includes a typical basket hoop 33 and a generally cylindrical backboard 39. A bracket 35 mounts the basket 33 to the backboard 39. The backboard 39 is mounted to a suitable supporting structure 23 by supports 40. The backboard 39 is generally cylindrical in shape and vertically disposed. The backboard 39 has a larger diameter than the basket hoop 33 and is concentric therewith. A typical cylindrical diameter for the backboard 39 is 26 inches (66 cm). The backboard 39 surrounds the basket hoop 33 for more than 180° of the circumference thereof. The line 41 marks the position from which the shot at station 13 should be taken. The phantom line 42 indicates one of the possible bank shots which may be made from the position 41. FIG. 4 is a perspective view of the basket hoop 33 and backboard 39 of shot making station 13. In one embodiment, the distance between the edges 43 and 44 of the backboard 39 is 25.25 inches (64.2 cm). The backboard 39 is typically 2½ feet (76.2 cm) high and the basket hoop 33 is centered thereon and mounted 6 inches (15.24 cm) from the bottom thereof.

The shot making station 14 is called the Wraparound Right Shot and includes a basket hoop 33 and a backboard 45. The backboard is vertically disposed and arcuate in shape along the horizontal cross-section. The basket hoop 33 is mounted to the backboard 45 near the end 48 thereof by a bracket 35. The backboard 45 is mounted to a suitable supporting structure 23 by the mounts 46 and 47. A line 48 indicates the position from which the shot at the shot making station 14 should be made and the phantom line 49 indicates one of the possible bank shots which may be made from this position. FIG. 5 shows a perspective view of the basket hoop 33 and backboard 45 of the shot making station 14. The horizontal cross-section of the backboard 45 describes an arc having a radius of 57 inches (144.78 cm) and measures approximately 66 inches (167.64 cm) between its edges 50 and 51. The bracket 35 is affixed to the backboard 45 approximately 6 inches (15.24 cm) from the side edge 50 thereof and approximately 6 inches (15.24 cm) from the bottom thereof.

The shot making station 15 is the mirror image of the shot making station 14 and is called the Wraparound Left Shot. It includes a hoop 33 mounted by a bracket 35 to a backboard 45', which in turn is mounted to a suitable support structure 23 by mounts 46' and 47'. The line 48' indicates the position from which the shot at station 15 should be made and the phantom line 49' indicates one of the possible bank shots which may be made from this station. A perspective view of the shot making station 15 is not shown; however, the dimensions are the same as that of shot making station 14 with the positions from left to right simply being reversed.

The shot making station 16 is called the Bankdown Shot and includes a basket hoop 33 mounted by a bracket 35 to a backboard 52. The backboard 52 is mounted to a suitable support structure 23 by mounts 53. The line 54 indicates the position from which the shot at station 16 should be made and the phantom line 55 indicates one of the possible bank shots which may be made from this position. FIG. 6 is a perspective view of the shot making station 16 showing the basket hoop 33 and the backboard 52. The backboard 52 comprises an upper section 56 and a lower section 57. FIG. 6 also shows the mounts 53 for mounting the backboard 52 to the suitable support structure 23. As shown, the supports 53 are connected to the upper section 56 of the backboard 52. Additional braces 58 are connected to the lower section 57 for mounting that portion of the backboard 52 to a suitable support structure 23. As shown, the lower section 57 is vertically disposed and the upper section 56 is angled over the basket hoop forming an angle 130° with the lower section 57. The upper section thereby forms an acute angle of 40° with the horizontally oriented basket hoop 33. The backboard 52 measures 2 feet (61 cm) wide, the lower section 57 is 22 inches (55.88 cm) in height, and the upper section 56 is 50 inches (127 cm) long. The basket hoop 33 is mounted in the horizontal center of the lower section 57 and approximately 6 inches (15.24 cm) from the bottom thereof.

Figures 1B, 7, 8, 9, 11:
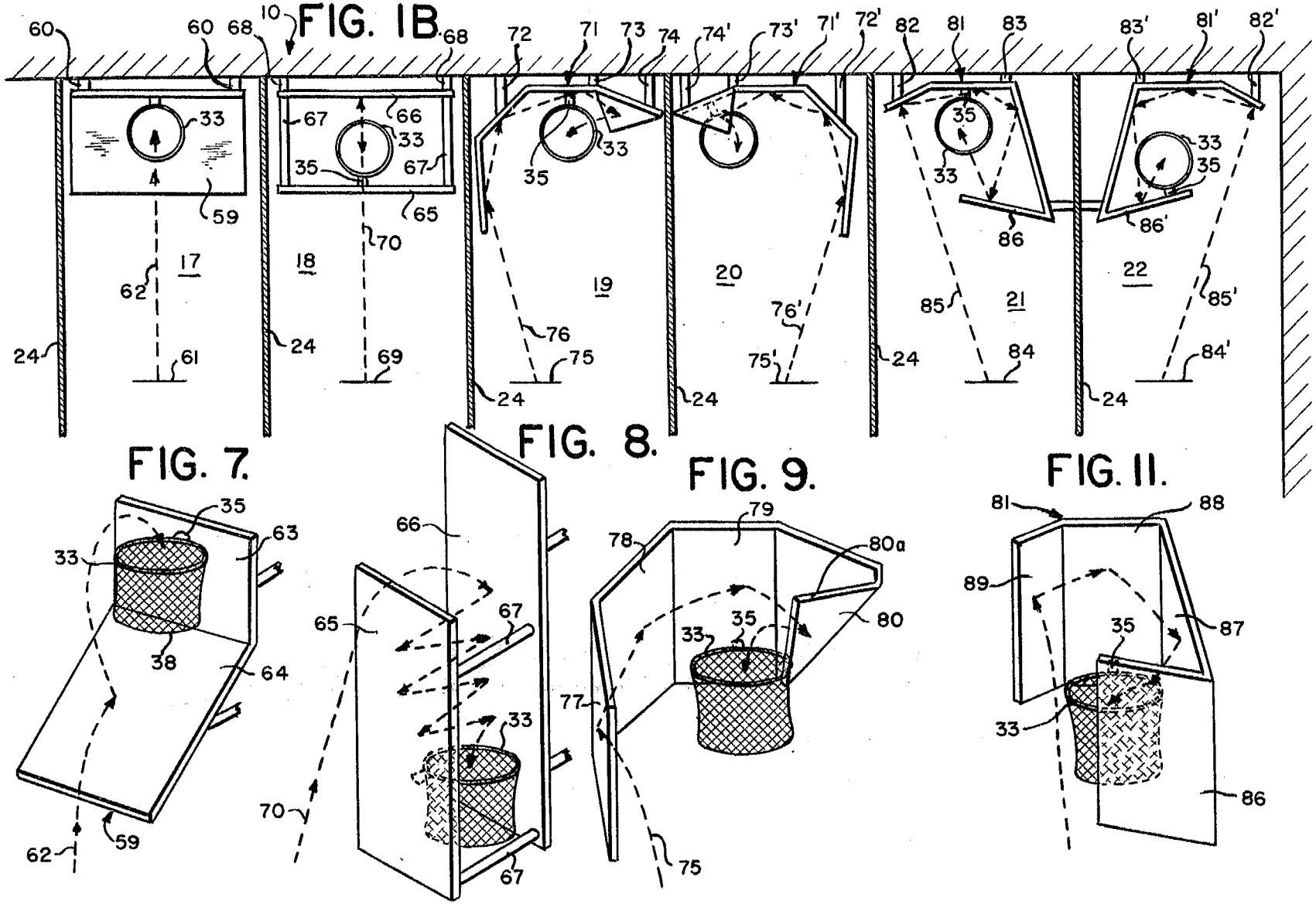

The shot making station 17 is called the Bankup Shot and includes a basket hoop 33 mounted on a backboard 59 by bracket 35. The backboard 59 is mounted on a suitable support structure 23 by mounts 60. The line 61 indicates the position from which the shot at station 17 should be made and the phantom line 62 indicates one possible bank shot which may be made from this position. FIG. 7 shows a perspective view of the shot making station 17 including the basket hoop 33, bracket 35 and backboard 59. The backboard 59 includes an upper section 63 which is vertically disposed and a lower section 64 which is angled under the basket hoop 33. The angled lower section 64 forms an angle of 110° with the upper section 63 and therefore forms an acute angle of 20° with the basket hoop 33. The backboard 59 is typically 2 feet (61 cm) wide with the upper section 63 being 22 inches (55.88 cm) high and the lower section 64 being 50 inches (127 cm) in length. The brackets 35 is typically mounted at the center horizontally of the backboard 59 and 6 inches (15.24 cm) from the top of upper section 63.

Shot making station 18 is called the Chute Shot and includes a basket hoop 33 mounted on a double "backboard" including the backboard 66 and the front board 65. The basket hoop 33 is mounted to the front board 65 by a bracket 35. Support braces 67 mount the front board 65 to the back-board 66 and additional braces 68 mount the backboard 66 to a suitable structure 23. The line 69 indicates the position from which the shot at station 18 should be made and the phantom line 70 indicates one of the possible bank shots which may be made from this position. FIG. 8 shows a perspective view of the basket 33 and boards 65 and 66 of shot making station 18. The boards 65 and 66 are diametrically disposed on opposite sides of the basket hoop 33 and as shown, the preferred shot making position is on a line perpendicular to the faces of the boards 65 and 66.

The boards 65 and 66 measure 2 feet (61 cm) across with the backboard 66 being 8 feet (2.44 meters) in height and the front board 65 being 6 feet (1.824 meters) in height. The basket hoop 33 is mounted half-way between the sides of each board 65 and 66 and approximately 3 feet (91.5 cm) from the bottoms thereof. The bottoms of boards 65 and 66 typically rest on the ground. The front board 65 and the backboard 66 are typically mounted 32 inches (81.28 cm) apart with the hoop 33 approximately centered therebetween. As shown by the orientation of the line 69 in FIG. 1B and the phantom line 70 in FIGS. 1B and 8, it is intended that the front board 65 be disposed between the preferred shot making position 69 and the basket hoop 33. In this manner, the basketball must be shot over a front board 65 and preferably rebounded between the boards 65 and 66 in order to reach the basket hoop 33. For this purpose, the front board 65 may be made of transparent structural material to allow the shooter to see the basket hoop 33 from the shot making position 69.

Shot making station 19 is called the Richochet Right up Shot and includes a basket hoop 33 and a backboard 71. The basket hoop 33 is mounted to the backboard 71 by a suitable bracket 35. The backboard 71 is mounted to a suitable support member 23 by mounts 72, 73 and 74. A line 75 indicates the position from which the shot at station 19 should be made and the phantom line 76 indicates one possible bank shot which may be made from the position 75. FIG. 9 is a perspective view of shot making station 19 including basket hoop 33 mounted to the backboard 71 by the bracket 35. The backboard 71 includes four sections 77, 78, 79 and 80. Sections 77, 78 and 79 are vertically disposed and serially connected forming various angles along their lines of intersection. Section 80 is connected to section 74 and the lower corner **80*a* of the unconnected side 80*b* is bent diagonally, toward the basket hoop 33 and upwardly. The bent portion of the section 80 forms a 90° angle with the remainder thereof. The bent portion 80*a* of the section 80 is defined by a diagonal line running from approximately 4 inches (10.16 cm) below the upper unconnected corner 80*c* to approximately 3 inches (7.62 cm) along the bottom of the section 80 from the lower connected corner 80*d*. The individual sections 77–80 are typically 2 feet (61 cm) in width and 3 feet (9.15 cm) in height. The basket hoop 33 is mounted approximately 6 inches (15.24 cm) from the bottom of the backboard section 79 and approximately 6 inches (15.24 cm) from the line of interconnection of sections 79 and 80. In one form, section 77 forms a 130° angle with section 78; section 79 forms a 135° angle with section 78; and section 80 forms a 160° angle with section 79**.

Figure 10:
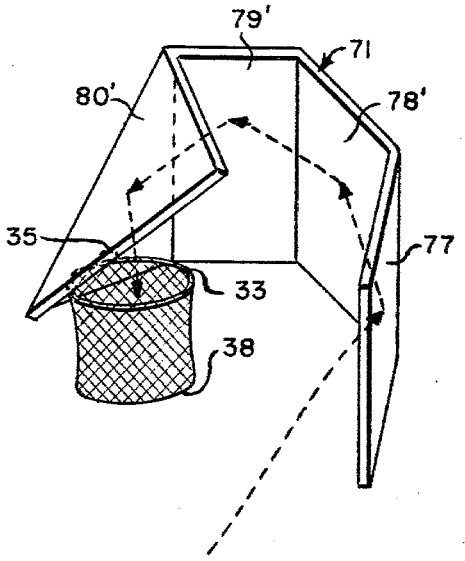
FIG. 10 is a perspective view of a backboard and hoop arrangement according to another of the shot making stations of FIG. 1B.

Shot making station 20 is called the Richochet Left Down Shot and includes a basket hoop 33 mounted by a bracket 35 to a backboard structure 71'. The backboard 71' is connected to a suitable support structure by supports 72', 73' and 74'. The line 75' indicates the position from which the shot at station 20 should be made and the phantom line 76' indicates one of the possible bank shots which may be made from this station. FIG. 10 is a perspective view of the shot making station 20 and includes the basketball hoop 33, mounting bracket 35 and backboard 71' including sections 77', 78', 79' and 80' thereof. As in FIG. 9, the backboard sections 77'–79' are interconnected and vertically disposed. The section 80' is connected to the section 79' and the upper unconnected corner **80*c'* thereof is bent diagonally, toward the basket hoop 33 and downwardly. The bent portion 80*c'* is defined by a diagonal line running from the unconnected lower corner 80*a'* to the connected upper corner 80*d'* of the section 80'. The bracket 35 is mounted approximately 6 inches (15.24 cm) from the bottom of section 80' and approximately in the middle thereof. In one form, section 77' forms a 130° angle with section 78'; section 79' forms a 135° angle with section 78'; and section 80' forms a 160° angle with the section 79'. The bracket 35** is mounted approximately 6 inches (15.24 cm) from the bottom of section 80' and approximately in the middle thereof.

Shot making station 21 is called the Carom Can It Right Shot and includes a basket hoop 33 mounted by a mounting bracket 35 to the backboard structure 81. The backboard structure is mounted to a suitable support structure 23 by supports 82 and 83. The line 84 indicates the preferred position for making a shot at station 21 and the phantom line 85 indicates one of the possible bank shots which may be made from this position. As shown, a section 86 of the backboard 81 is disposed between the shot making position 84 and the basket hoop 33. FIG. 11 shows a perspective view of the shot making station 21 including the basket hoop 33, mounting bracket 35 and backboard 81. The backboard 81 includes sections 86, 87, 88 and 89 which are interconnected and surround all but a small portion of the basket hoop 33. Each of the sections 86–89 is vertically disposed and approximately 3 feet (91.5 cm) in height. Section 89 is typically 1 foot (30.5 cm) wide. Sections 88 and 86 are typically 2 feet (61 cm) wide and section 87 is typically 3 feet (91.5 cm) wide. As shown in FIGs. 1B and 11, the section 86 is normally disposed between the shot making position 84 and the basket hoop 33. For this reason, the section 86 may be made of transparent material to allow a person making shots from the position 84 to see the basket hoop 33. As shown in the figures, the basket hoop 33 for this section is mounted on section 88, approximately 6 inches (15.24 cm) from the bottom and approximately in the middle thereof. Alternatively, the basket hoop may be mounted on section 86, approximately 6 inches (15.24 cm) from the bottom and approximately 6 inches (15.24 cm) from the unconnected end thereof. This alternate mounting position is shown at shot making station 22 which is otherwise the mirror image of station 21. In the figures, section 88 is mounted flat against the support structure 23; section 89 forms an angle of 130° with section 88; section 87 forms a 105° angle with section 88 and section 86 forms a 65° angle with section 87.

Figure 12:
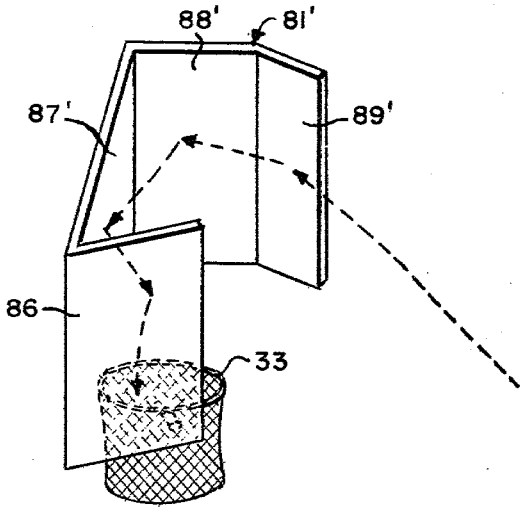
FIG. 12 is a perspective view of a backboard and hoop arrangement according to yet another of the shot making stations of FIG. 1B.

The shot making station 22 is called the Carom Can It Left Shot and, as mentioned, is substantially the mirror image of the shot making station 21. The station 22 includes a basket hoop 33 mounted by a bracket 35 to a backboard 81'. The backboard 81' is mounted to a suitable support structure 23 by supports 82' and 83'. The line 84' shows the preferred shot making position for the station 22 and the phantom line 85' shows one of the possible bank shots which may be made from this position. FIG. 12 shows a perspective view of the shot making station 22 with the basket hoop 33 and backboard 81'. The backboard 81' includes sections 86', 87', 88' and 89' which are vertically disposed and serially connected along their sides to surround all but a small portion of the basket hoop 33. The sections 86'–89' are typically 3 feet (91.5 cm) in height. Section 89' is typically 1 foot (30.5 cm) wide. Sections 88' and 86' are typically 2 feet (61 cm) wide, and section 87' is typically 3 feet (91.5 cm) wide. As shown in FIGS. 1B and 12, the section 86' is disposed between the shot making position 84' and the basket hoop 33. For this reason, the section 86' may be made from transparent material to allow the basket hoop 33 to be seen from the shot making position 84'.

In the figures, the basket hoop 33 or bracket 35 is mounted on section 86', approximately 6 inches (15.24 cm) from the bottom and approximately 6 inches (15.24 cm) from the unconnected end thereof. The sections 86'–89' are all typically 3 feet (91.5 cm) high; section 88' is mounted flat with respect to the support structure 23 and is approximately 2 feet (61 cm) wide; section 89' is approximately 1 foot (30.5 cm) wide and forms an angle of 130° with section 88'; section 87' is approximately 3 feet (91.5 cm) wide and forms an angle of 105° with section 88'; and section 86' is approximately 2 feet (61 cm) wide and forms an angle of 65° with section 87'.

The backboards shown and described may be fabricated from flat structural material. Preferably, such material is clear to allow fabrication of those backboard sections disposed between the basket hoop and the preferred shooting position. It is also preferable that the material be capable of being curved and bent to allow the easy formation of the various shapes described herein. A possible material for use in producing these backboards is a plastic based on polymerized methyl methacrylate resin, such as those varieties sold under the trademark LUCITE belonging to E. I. du Pont de Nemours and Company. The material used is typically ½–1 inche (1.27–2.54 cm) thick.

In practice, the shot making stations described with respect to the appended drawings may be used to play a variety of different games. Any number of the shot making stations may be combined to develop a particular game and any system of scoring may be used. Shots may be made from the prescribed position for each station, or they may be made from any other position. As shown in FIG. 1A, at shot making station 12, a plurality of shot making stations 36, 90 and 91 may be used wherein each of the different positions they represent may be the preferred shot making station for persons of different ability. As mentioned, the line 36 may be 15 feet (45.75 cm) along the ground from the basket. Line 90 may, in turn, be 13 feet (3.965 meters) and line 91 may, in turn, be 11 feet (3.355 meters). The particular shots described by the phantom lines at each shot making station may be used or different shots may also be used.

In one game devised for the present arrangement of shot making stations, each person takes five shots at each station and different points are awarded for each shot made. For example, 10 points for the first shot; 5 points for the second shot; 4 points for the third shot; 3 points for the fourth shot and 2 points for the fifth shot. A similar form of this game only allows three shots at each station and can therefore be used, at the operator's discretion, to expedite play, such as when a large number of people are waiting to play.

In one form of the game, each player is required to make a specific bank or swish shot at each station. This may be accomplished by indicating, in a suitable manner, which of the backboard sections the ball must be banked off of. Backboard markings, such as the circle 34*a*, may be used to indicate which areas of the backboards must be hit to obtain credit for the shot. Optionally, any shot may be allowed at one or more of the stations with the backboard markings being used to indicate possible shots.

The present shot making game is intended to take many forms. In one form, it may be full-size according to the dimensions given herein. It may be set up indoors where the support structure 23 takes the form of a wall, or outdoors where the support structure 23 is either a wall or poles implanted in the ground. The game may also be constructed in a miniature form for small children, or even reduced to the point where it can be played in an ordinary room, such as a playroom with 8 foot ceilings. In addition, the game may be adapted to playing cards or even transformed into two dimensions, such as those shown in FIGS. 1A and 1B and as combined in FIG. 1C, for conversion to an electronic video game.

In addition to being capable of being used in a multistation shot making game, the basket hoop and backboard arrangements of the present invention may be used individually to play any form of conventional basketball game in an otherwise normal manner.

It is to be understood that the forms of the present invention, herein shown and described, are to be taken as preferred examples of the same and that various changes in shape, size and arrangement may be resorted to, without departing from the scope of the appended claims.

What is claimed is:

1. In a basketball shot making game comprising a court surface and a plurality of spaced apart backboards disposed above said court surface, each of said backboards being associated with a basket hoop adapted to receive a shot basketball caromed thereinto off said associated backboard; the improvement comprising a first predetermined angulated relationship for one of said backboards, said one backboard comprising a first plurality of carom surfaces with said one backboard being supported above said court surface with said associated basket hoop being disposed in a plane substantially parallel to the plane of said court surface, said first plurality of carom surfaces including at least one carom surface disposed in a plane angled with respect to a plane normal to the plane of said associated basket hoop, said first plurality of carom surfaces defining said first predetermined angulated relationship, said first predetermined angulated relationship defining a first associated carom flight path for depositing said shot basketball into said basket hoop associated therewith; and a second predetermined angulated relationship for a different one of said backboards, said different one of said backboards comprising a second plurality of carom surfaces with said different one backboard being supported above said court surface with said associated basket hoop being disposed in a plane substantially parallel to the plane of said court surface, said second plurality of carom surfaces including at least one carom surface disposed in a plane angled with respect to both a plane normal to the plane of said associated basket hoop and a plane parallel to the plane of said associated basket hoop, said second plurality of carom surfaces defining said predtermined angulated relationship, said second predetermined angulated relationship being different from said first predetermined angulated relationship and defining a second associated carom flight path for depositing said shot basketball into said basket hoop associated therewith, said first and second associated carom flight paths being different, said first carom flight path intercepting the flight of said shot basketball and requiring said intercepted shot basketball to travel along a substantially horizontal trajectory with respect to said associated basket hoop between said one carom surface and said associated basket hoop in order to ultimately deposit said shot basketball into said associated basket hoop, said second carom flight path intercepting the flight of said shot basketball and requiring said intercepted shot basketball to travel along a substantially vertical trajectory with respect to said associated basket hoop between said one carom surface and said basket hoop in order to ultimately deposit said shot basketball into said associated basket hoop, said plurality of backboards being arrayed above said court surface in a course defined by a plurality of shot making stations with one of said backboards being disposed at each of said shot making stations, whereby a different shot making carom strategy is required at each of said stations.

2. A shot making game in accordance with claim 1 wherein each of said plurality of spaced apart backboards has a different predetermined angulated relationship defining a different associated unique carom flight path for depositing said shot basketball into said basket hoop.

3. A shot making game in accordance with claim 1 wherein said course further comprises an additional shot making station comprising an additional spaced apart basket hoop supported above said court surface without a backboard for enabling said shot basketball to be deposited directly therein, said shot basketball having a further unique flight path with respect to that required at said other shot making stations.

4. A shot making game according to claim 1, wherein said one backboard at one of said shot making stations is in a plane substantially normal to the plane of said basket hoop with said carom surfaces being concentric with the associated basket hoop and surrounding said basket hoop for more than 180°.

5. A shot making game according to claim 1, wherein said one backboard at one of said shot making stations is in a plane substantially normal to the plane of said basket hoop with said carom surfaces being arcuate in horizontal cross section and covering an arc of less than 180°, said associated basket hoop being mounted near one end thereof.

6. A shot making game according to claim 1, wherein said different one backboard at one of said shot making stations has a lower portion which is in a plane substantially normal to the plane of said associated basket hoop and an upper portion which is angled over said associated basket hoop at an acute angle therewith, said upper portion being said one angled carom surface.

7. A shot making game according to claim 1, wherein said different one backboard at one of said shot making stations has an upper portion which is in a plane substantially normal to the plane of said associated basket hoop and a lower portion which is angled under and extends beyond said associated basket hoop forming an acute angle therewith, said lower portion being said one angled carom surface.

8. A shot making game according to claim 1, wherein said course further comprising an additional shot making station having a double backboard diametrically disposed on opposite sides of an associated basket hoop and a shot making position which lies on a line perpendicular to the surfaces of said double backboard and passing through the center of said basket hoop, said basket hoop being disposed in a plane substantially parallel to the plane of said court surface and said double backboards being disposed in parallel planes substantially normal to the plane of said basket hoop.

9. A shot making game according to claim 1, wherein said different one backboard at one of said shot making stations has first, second, third and fourth sections serially connected along their sides, said sections comprising said carom surfaces, said first, second and third sections being flat and being disposed in planes substantially normal to the plane of said basket hoop and said fourth section being said one angled carom surface and having the lower portion of the unconnected side thereof positioned diagonally, toward said associated basket hoop and upwardly.

10. A shot making game according to claim 1, wherein said one backboard at one of said shot making stations has first, second, third and fourth sections which are disposed in planes substantially normal to the plane of said associated basket hoop and serially connected along their sides to surround all except a small portion of said associated basket hoop with said fourth section being located between a predetermined shooting position and said associated basket hoop, and with said sections comprising said carom surfaces.

11. A shot making game according to claim 1 wherein said different one backboard at one of said shot making stations has first, second, third and fourth sections serially connected along their sides, said sections comprising said carom surfaces, said first, second and third sections being flat and being disposed in planes substantially normal to the plane of said basket hoop and said fourth section being said one angled carom surface and having the upper portion of the unconnected side thereof positioned diagonally toward said associated basket hoop and downwardly.

12. A basketball backboard and hoop, comprising a longitudinally open cylindrical backboard, supportable above a court surface in a plane substantially normal to said court surface and being concentric with a basketball hoop which is substantially horizontally oriented with respect thereto in a plane substantially parallel to said court surface, said cylindrical backboard surrounding said basketball hoop for more than 180° for providing a plurality of carom surfaces with respect to said basketball hoop.

13. A basketball backboard and hoop comprising a backboard supportable above a court surface, said backboard having first, second, third and fourth sections serially connected along their sides, said sections comprising carom surfaces for a basketball to be deposited in said hoop said hoop being disposed in a plane substantially parallel to the plane of the court surface and being a horizontally oriented basket hoop mounted to one of said sections, said first, second and third sections being flat and being disposed in planes substantially normal to the plane of said hoop and said fourth section having the lower portion of the unconnected side thereof positioned diagonally, toward said basket hoop and upwardly and being disposed in a plane at an angle to both the plane of the basket hoop and a plane normal thereto.

14. A basketball backboard and hoop comprising a backboard supportable above a court surface, said backboard having first, second, third and fourth sections serially connected along their sides, said sections comprising carom surfaces for a basketball to be deposited in said hoop, said hoop being disposed in a plane substantially parallel to the plane of the court surface and being a horizontally oriented basket hoop mounted to one of said sections, said first, second and third sections being flat and being disposed in planes substantially normal to the plane of said hoop and said fourth section having the upper portion of the unconnected side thereof positioned diagonally, toward said basket hoop and downwardly and being disposed in a plane at an angle to both the plane of the basket hoop and a plane normal thereto.

* * * * *